US007104257B2

(12) United States Patent
Kawamoto et al.

(10) Patent No.: US 7,104,257 B2
(45) Date of Patent: Sep. 12, 2006

(54) SUPPORT STRUCTURE OF FUEL INJECTOR

(75) Inventors: Yutaka Kawamoto, Yokohama (JP); Yuji Azuma, Yokohama (JP); Yasushi Fujiwara, Takahashi (JP)

(73) Assignees: Nissan Motor Co., Ltd., Yokohama (JP); Eagle Industry Co., Ltd., Tokyo (JP)

( * ) Notice: Subject to any disclaimer, the term of this patent is extended or adjusted under 35 U.S.C. 154(b) by 0 days.

(21) Appl. No.: 11/226,352

(22) Filed: Sep. 15, 2005

(65) Prior Publication Data

US 2006/0065245 A1 Mar. 30, 2006

(30) Foreign Application Priority Data

Sep. 16, 2004 (JP) ..... 2004-269521

(51) Int. Cl.
*F02M 61/14* (2006.01)
*F02M 69/46* (2006.01)

(52) U.S. Cl. ..... 123/470; 123/456

(58) Field of Classification Search ..... 123/470, 123/467, 468, 469, 456; 239/587.1
See application file for complete search history.

(56) References Cited

U.S. PATENT DOCUMENTS

| | | | | |
|---|---|---|---|---|
| 4,295,452 | A | 10/1981 | Lembke et al. | |
| 5,970,953 | A | 10/1999 | Lorraine et al. | |
| 6,148,797 | A | 11/2000 | Gmelin | |
| 6,640,784 | B1 | 11/2003 | Sims, Jr. | |
| 6,871,634 | B1 * | 3/2005 | Berger et al. | 123/456 |
| 6,877,484 | B1 * | 4/2005 | Reiter | 123/468 |
| 6,923,162 | B1 * | 8/2005 | Reiter | 123/490 |
| 2004/0050365 | A1 * | 3/2004 | Reiter | 123/468 |
| 2004/0112338 | A1 * | 6/2004 | Berger et al. | 123/468 |
| 2004/0194764 | A1 | 10/2004 | Okajima et al. | |
| 2006/0118091 | A1 * | 6/2006 | Zdroik | 123/470 |

FOREIGN PATENT DOCUMENTS

| | | | |
|---|---|---|---|
| DE | 103 34 118 | A1 | 3/2004 |
| EP | 0 969 203 | A1 | 1/2000 |
| EP | 1 134 406 | A2 | 9/2001 |
| JP | 8-158988 | A | 6/1996 |
| JP | 2001-511867 | A | 8/2001 |
| JP | 2004-245168 | A | 9/2004 |
| WO | WO 2004/051074 | A1 | 6/2004 |

* cited by examiner

*Primary Examiner*—Mahmoud Gimie
(74) *Attorney, Agent, or Firm*—Foley & Lardner LLP

(57) ABSTRACT

A cylindrical fuel injector (1) has a projecting part (2) projecting in a lateral direction. A cylinder head (5) has a hole (18) for inserting the fuel injector (1). An elastic member (6) is formed in a cylindrical shape with a notch to have a C-shaped cross-section. The elastic member (6) is fitted to the fuel injector (1) on the opposite side from the projecting part (2) to elastically support the fuel injector (1) in a state where a tip (1*a*) of the fuel injector (1) is inserted into the hole (18). A support member (3) supports the elastic member (6) and a snap ring (16) prevents deformation of the elastic member (6) in a lateral direction with respect to an axis of the fuel injector (1) under a compressive load exerted by the engine member (5) and the support member (3).

10 Claims, 6 Drawing Sheets

SUPPORT STRUCTURE OF FUEL INJECTOR

FIELD OF THE INVENTION

This invention relates to the support structure of a fuel injector of an internal combustion engine.

BACKGROUND OF THE INVENTION

The fuel injector of an in-cylinder injection internal combustion engine is generally disposed in a hole formed in a cylinder head such that the tip of the injector faces a combustion chamber. The fuel injector of an in-port injection internal combustion engine is usually disposed in a hole formed in an intake manifold body such that the tip of the injector faces an intake port of the engine. In both cases, the fuel injector is formed in a cylindrical shape and a support member fixed to the cylinder head or the intake manifold by a bolt or the like, pushes the fuel injector in the tip direction via a spring, and restrict the displacement of the fuel injector.

However, if there is non-uniformity in the sizes of the fuel injector parts, the direction of the load acting on the fuel injector will shift away from the main axis of the fuel injector, and the load acting on the fuel injector may be eccentric. This unbalanced load shifts the holding angle of the fuel injector away from the desired angle, and has an undesirable affect on the fuel injection amount and the spray characteristics of the fuel injector.

SUMMARY OF THE INVENTION

Tokkai 2001-511867 published by the Japan Patent Office in 2001 proposes connecting the fuel injector and a fuel supply pipe via a sleeve which fits into the outer circumference of the fuel injector. On the outside of the sleeve, a coil spring is interposed between the fuel injector and fuel supply pipe. For this purpose, a flange which supports the end of the coil spring is formed in the outer circumference of the fuel injector.

The fuel injector is supported while being pushed against the cylinder head by the reaction force of the coil spring which acts via the flange.

The fuel injector of the prior art is an electromagnetic fuel injector which responds to an electromagnetic pulse, and is a top-feed type fuel injector which is connected to the fuel supply pipe at its base end. In this fuel injector, a connector connected to pulse signal input wiring projects from the lateral surface of the fuel injector.

On the other hand, in a side-feed type fuel injector, unlike the prior art, the fuel supply pipe is connected to the lateral surface of the fuel injector, and a connector is provided at the base end of the fuel injector. However, a connecting part of the fuel supply pipe projects from the lateral surface of the fuel injector instead. In other words, electromagnetic fuel injectors have a projecting part like a connector or a pipe connection part on their lateral surface regardless of type. In the prior art, to avoid interference between the connector and coil spring which project on the lateral surface of the top-feed type fuel injector, the flange which supports the coil spring is formed above the connector, i.e., near the base end.

Therefore, at least a space to instal the connector and a space for the coil spring must be provided separately in the axial direction, and the axial length of the fuel injector unavoidably becomes long.

It is therefore an object of this invention to avoid interference between the projecting part on the lateral surface of a fuel injector and an elastic member which pushes the fuel injector, and shorten the axial length of the fuel injector.

In order to achieve the above object, this invention provides a support structure for a fuel injector of an internal combustion engine. The fuel injector is formed in a cylindrical shape, and has a projecting part projecting in a lateral direction. The structure comprises an engine member which has a hole for inserting the fuel injector, an elastic member formed in a cylindrical shape with a notch to have a C-shaped cross-section, and fitted to the fuel injector on the opposite side from the projecting part to elastically support the fuel injector in a state where a tip of the fuel injector is inserted into the hole, a support member which supports the elastic member, and a member which prevents deformation of the elastic member in a lateral direction with respect to an axis of the fuel injector under a compressive load exerted by the engine member and the support member.

The details as well as other features and advantages of this invention are set forth in the remainder of the specification and are shown in the accompanying drawings.

DESCRIPTION OF THE PREFERRED EMBODIMENTS

Figure 1:
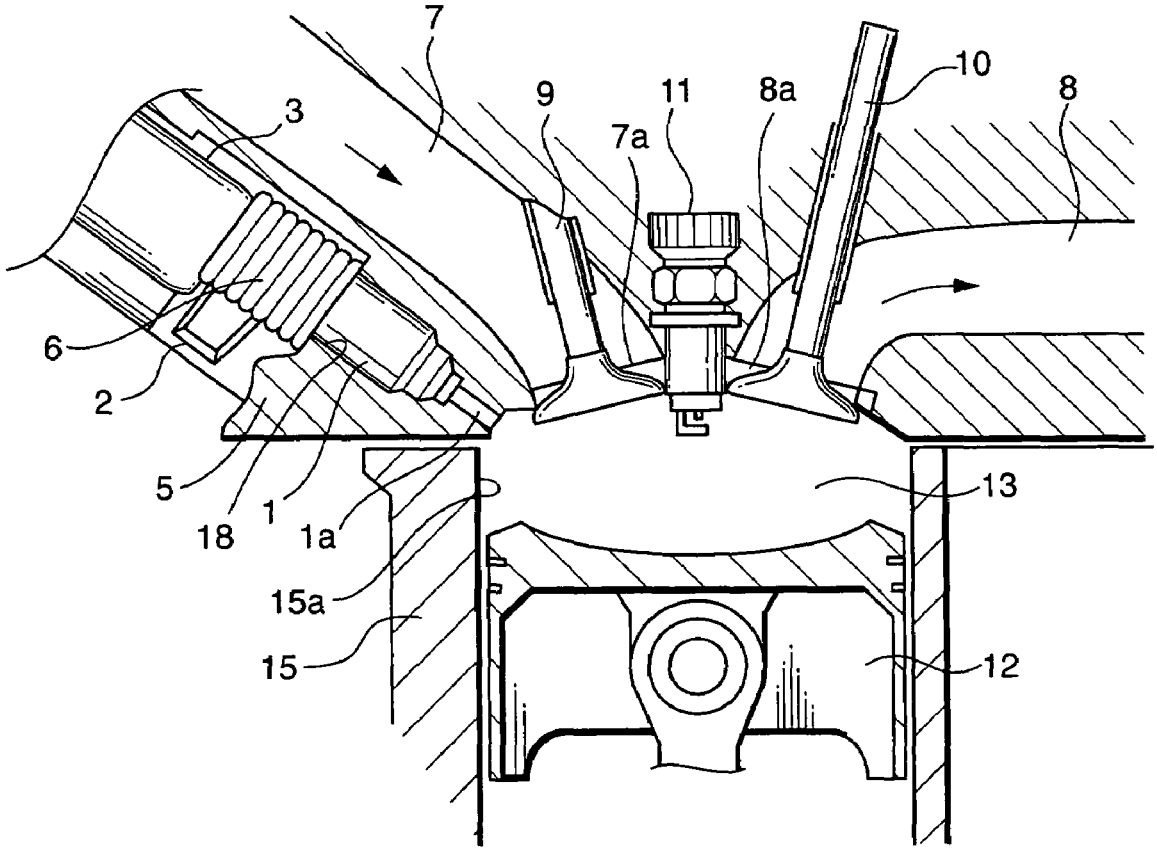
FIG. 1 is a longitudinal sectional view of the essential parts of an internal combustion engine showing a fuel injector support structure according to this invention.

Referring to FIG. 1 of the drawings, an in-cylinder injection internal combustion engine is provided with a cylinder block 15 and a cylinder head 5 disposed thereupon. A cylinder 15*a* is formed inside the cylinder block 15, and a piston 12 is housed inside. A combustion chamber 13 is formed by the piston 12, the wall surfaces of the cylinder 15 and the cylinder head 5 in the cylinder 15*a*. An intake port 7 and exhaust port 8 which open towards the combustion chamber 13 are formed in the cylinder head 5. An intake valve 9 is formed in an opening 7*a* which faces the combustion chamber 13 of the intake port 7. An exhaust valve 10 is formed in an opening 8*a* which faces the combustion chamber 13 of the exhaust port 8.

A spark plug 11 whereof the tip is oriented towards the center of the combustion chamber 13 is installed in the cylinder head 5. A fuel injector 1 is installed in a locating hole 18 formed under the intake port 7 in the cylinder head 5.

The internal combustion engine is a four-stroke cycle engine which performs intake, compression, expansion and exhaust in that order.

In the intake stroke, the piston 12 slides down the cylinder 15*a*, and when the air intake valve 9 opens, air is aspirated from the intake port 7 into the combustion chamber 13. In the compression stroke, the air intake valve 7 closes and the piston 12 slides up the cylinder 15*a* to compress the air. The fuel injector 1 injects fuel into the compressed air. As a result, an air-fuel mixture is formed around the spark plug 11. The fuel-air mixture burns due to ignition by the spark plug 11, and the piston 12 is depressed by the pressure of combustion gas. This piston depression corresponds to the expansion stroke. The depressed piston rotates a crankshaft via a piston rod.

In the exhaust stroke, the piston 12 is pushed up by the inertia of the rotating crankshaft. At this time, the exhaust valve 8 opens, and combustion gas in the combustion chamber 13 is discharged from the exhaust port 8 to the outside as exhaust gas. In this embodiment, the fuel injector 1 is formed under the intake port 7, but the fuel injector 1 can be disposed above the intake port 7 such that the tip is located at the top part of the combustion chamber 13.

Figure 2:
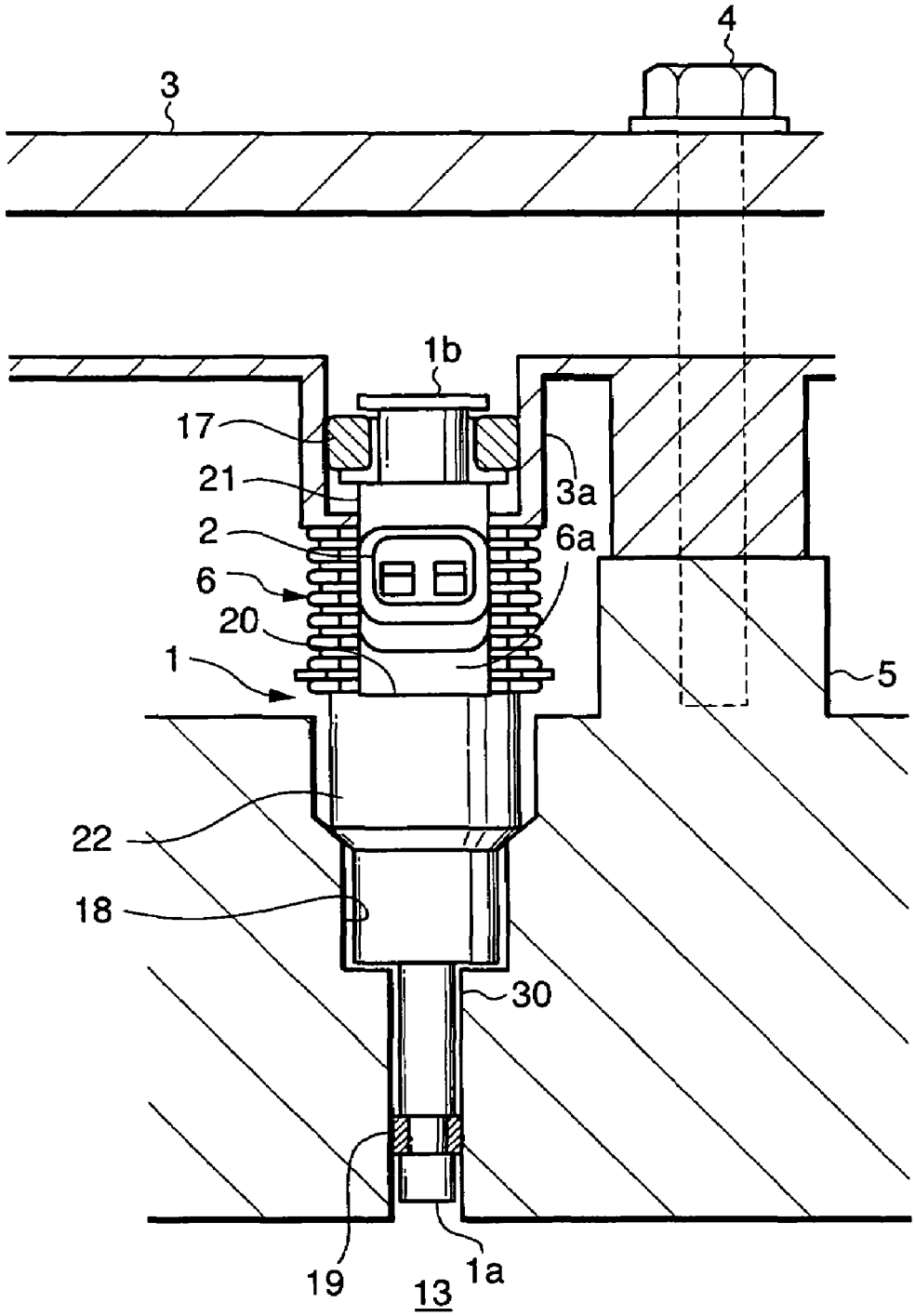
FIG. 2 is a longitudinal sectional view of the fuel injector support structure.

Referring to FIG. 2, the fuel injector 1 is a "top-feed type fuel injector", and is provided with a nozzle 1*a* for injecting fuel into the combustion chamber 13 at its tip. A pipe connector 1*b* connected to the fuel supply pipe 3 is formed at the base end of the fuel injector 1. Fuel pressurized by a fuel pump is supplied to the fuel injector 1 via the fuel supply pipe 3.

The fuel supply pipe 3 is fixed to the cylinder head 5 via a bolt 4. A holder 6 is fitted into the outer circumference of the fuel injector 1 near its base end. The holder 6 is a metal, bellows-shaped elastic member, whereof one end is supported by the fuel supply pipe 3, and the other end pushes the fuel injector 1 in the tip direction.

The diameter of the fuel injector 1 changes in several steps from the base end having the pipe connector 1*b* towards the tip in which the spray nozzle 1*a* is formed, i.e., from the upper end to the lower end in the figure. In particular, in a middle spring receptacle part 20, the diameter suddenly changes, the diameter of a large diameter part 22 below the spring receptacle part 20 being much larger than the diameter of a cylindrical part 21 from the large diameter part 22 to the upper end.

The diameter of the large diameter part 22 changes midway, and comprises an upper part directly below the spring receptacle part 20, and a lower part having a slightly smaller diameter. The fuel injector 1 further comprises a tip part 30 having a largely reduced diameter below the large diameter part 22. A nozzle 1*a* is formed at the lower end of the tip part 30. In other words, the fuel injector 1 has a reduced diameter at two places below the spring receptacle part 20, i.e., the middle of the large diameter part 22, and the lower end of the large diameter part 22. A connector 2 for connection of a signal cable which inputs a pulse signal projects from the lateral surface of the cylindrical part 21.

To accommodate the large diameter part 22 and tip part 30, the locating hole 18 in the cylinder head 5 has a level difference corresponding to the two-step diameter reduction of the fuel injector 1. The dimensions of the tip part 30 and the hole 18 are set so the nozzle 1*a* does not project into the combustion chamber 13 when the fuel injector 1 is inserted in the locating hole 18. A gap between the outer circumference of the tip part 30 and the wall surface of the locating hole 18 is sealed off from the combustion chamber 13 by a seal member 19. The cylindrical part 21 penetrates a boss 3*a* formed in the fuel supply pipe 3. Fuel in the fuel supply pipe 3 is supplied to the fuel injector 1 via the pipe connector 1*b* which opens inside the boss 3*a*.

To prevent fuel leaks from the fuel supply pipe 3 into the gap between the outer circumference of the cylindrical part 21 and the wall surface of the boss 3*a*, a seal member 17 is interposed between the cylindrical part 21 and the boss 3*a*. As described with reference to FIG. 1, the fuel supply pipe 3 is fixed to the cylinder head 5 via the bolt 4.

The holder 6 is gripped by the lower end of the boss 3*a* and the spring receptacle part 20. The distance between the lower end of the boss 3 and the spring receptacle part 20 is set to be shorter than the free length of the holder 6 when the fuel supply pipe 3 is fixed to the cylinder head 5.

Figure 3:
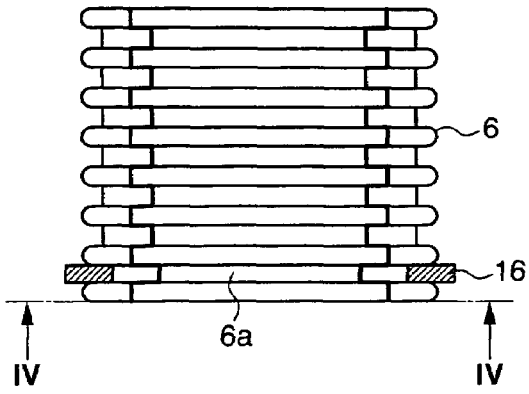
FIG. 3 is side view of a holder and a snap ring according to this invention.
Figure 4:
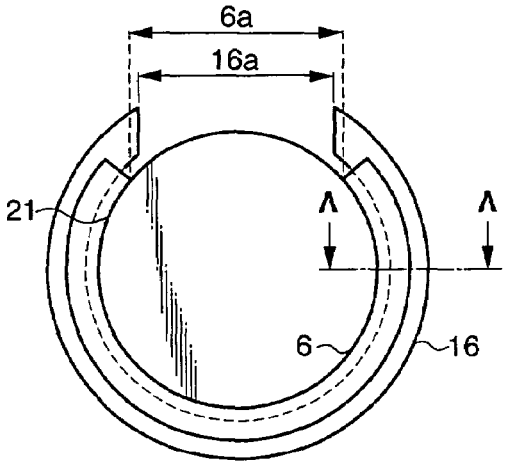
FIG. 4 is a plan view of the holder and the snap ring seen from the direction designated by the arrow IV—IV in FIG. 3.

Due to this setting, the holder 6 can always push the fuel injector 1 in the tip direction when the internal combustion engine is in use. As described above, the holder 6 is a metal, bellows-shaped elastic member, and, as shown in FIG. 3, it has a cylindrical shape in which a notch 6*a* running vertically through in an axial direction, is formed. In other words, the holder 6 is provided with a C-shaped cross-section as shown in FIG. 4. The notch 6*a* is formed at a fixed width over the full length of the holder 6, its width is being slightly larger than the width of the connector 2. When the holder 6*c* is fitted to the fuel injector 1, the curved surface of the cylindrical part 21 on the opposite side to the connector 2 is pressed into the notch 6*a*. When the holder 6 has been properly fitted, as shown in FIG. 2, the connector 2 projects from the notch 6*a* in the lateral direction of the holder 6.

By forming such a notch 6*a* in the holder 6, the connector 2 and holder can be arranged in the same plane while avoiding interference. The outer diameter of the holder 6 is set to a size which is a little less than the outer diameter of the spring receptacle part 20. After the fuel injector 1 is set in the locating hole 18, the holder 6 is fitted on the outer circumference of the cylinder part 21. Since the fuel supply pipe 3 and intake port 7 are close to the circumference of the fuel injector 1, this size setting is preferable to prevent interference between the holder 6 and these members when the holder 6 is fitted in the cylindrical part 21.

The holder 6 must be an elastic member. If the holder 6 does not have elasticity, the fuel injector 1 is not pushed in the tip direction and scatter in the dimensions of the boss 3*a*, holder 6, fuel injector 1 and hole 18 is not absorbed, so due to the unbalanced load, the fuel injector 1 inclines in the locating hole 18, and a desirable spray contour and required fuel injection amount are no longer obtained. By forming the holder 6 from an elastic member, the scatter in the dimensions of the members can be compensated, and the fuel injector 1 can always be held in contact with the steps of the hole 18*a*.

Next, referring to FIG. 8, the spring characteristics of the holder 6 will be described.

If a compressive force is applied to the holder 6 with a free length from the axial direction, the holder 6 will contract and elastic force will increase according to the contraction distance. However, after the contraction distance exceeds a distance L0 shown in the figure, the elastic force does not increase any more even if the holder 6 further contracts to distances L1 and L2.

Figure 8:
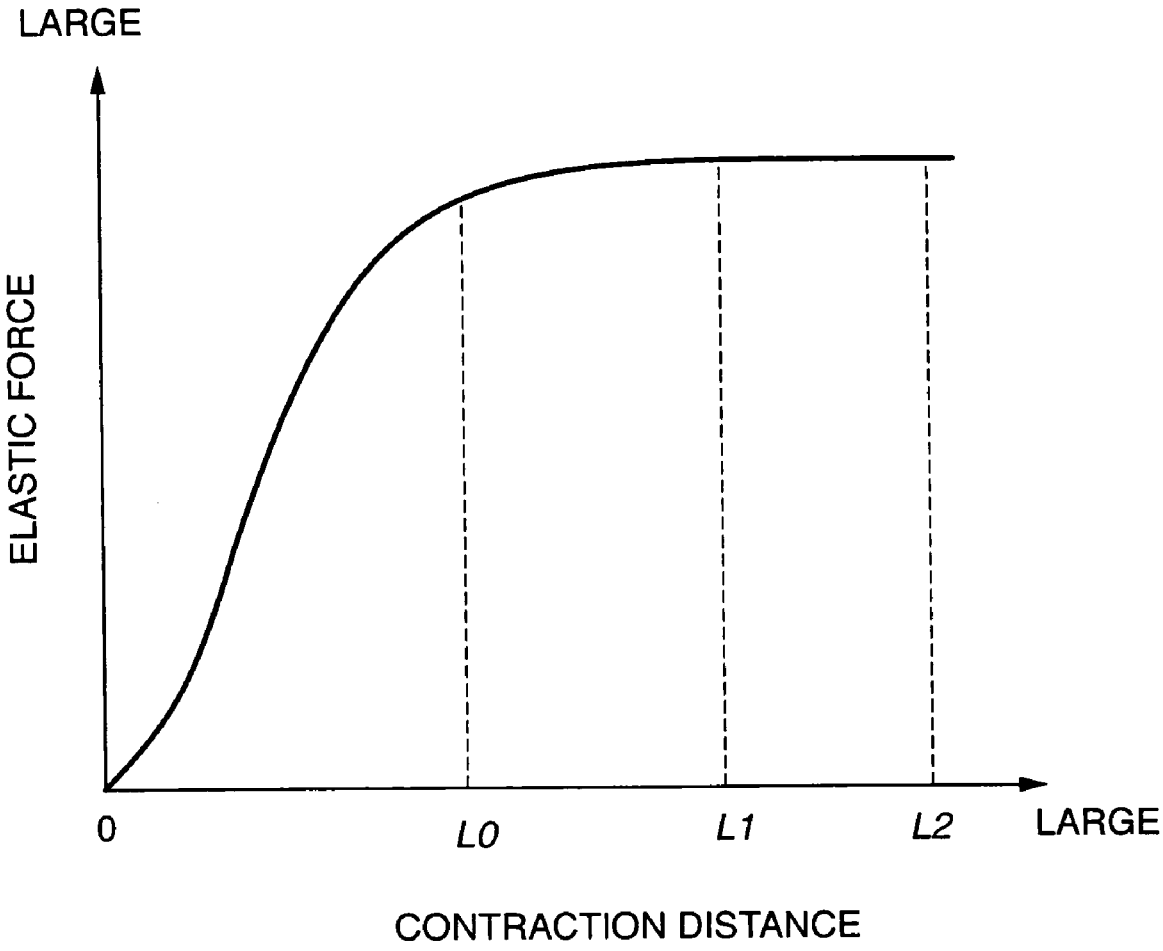
FIG. 8 is a diagram describing a relation between a contraction distance and an elastic force of a coil spring.

In this embodiment, the length of the holder 6 is set beforehand so that the contraction distance of the holder 6 when the fuel injector 1, holder 6, and fuel supply pipe 3 are in the assembled state shown in FIG. 2, lies between the contraction distances L1, L2 of FIG. 8. Due to this setting, the elastic force applied by the holder 6 to the fuel injector 1 can be maintained almost constant regardless of scatter in the dimensions of the boss 3*a*, holder 6, fuel injector 1 and locating hole 18.

Figure 5:
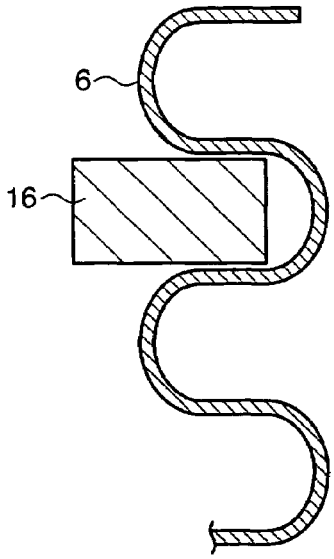
FIG. 5 is an enlarged sectional view of a part of the holder and the snap ring taken along the line V—V in FIG. 4.

Referring again to FIG. 3, a snap ring 16 is made to fit into the outer circumference of the lower end of the holder 6 as a member for preventing widening of the holder 6. The snap ring 16 is formed in the same C-shape as the cross-section of the holder 6 as shown in FIG. 4, and is inserted in an annular groove formed beforehand in the outer circumference of the lower end of the holder 6 as shown in FIG. 5. The width of an opening 16*a* of the snap ring 16 is set equal to or less than the width of the notch 6*a* of the holder 6 as shown in FIG. 4.

The holder 6 which has the notch 6*a* running vertically through it as shown in FIG. 3, tends to bulge outwards so that the notch 6*a* widens when a load acts in the axial direction. Here, if the notch 6*a* widens, the load in the axial direction which acts on the holder 6 escapes in a lateral direction without being transmitted to the spring receptacle part 20 shown in FIG. 2. Also, when the lower end of the deformed holder 6 bulges outside the spring receptacle part 20, the lower end of the holder 6 and the outer surface 5*a* of the cylinder head 5 interfere with each other, so the holder 6 can no longer push the spring receptacle part 20.

The snap ring 16 has the role of preventing this bulging deformation in the diameter increase direction of the holder 6, and preventing the lower end of the holder 6 from falling off the spring receptacle part 20. In this embodiment, the snap ring 16 is fitted to the lower end of the holder 6, but provided that it is lower than the middle part in the vertical direction of the holder 6, it can be fitted to a position other than the lower end.

As described above, in this invention, the notch 6*a* is formed in the holder 6 which is an elastic member, and the connector 2 is made to project from the notch 6*a* in a lateral direction. On the other hand, the snap ring 16 which prevents bulging deformation of the holder 6 is fitted to the holder 6, so the force pushing the fuel injector 1 can be maintained while the holder 6 and connector 2 remain in the same plane. Due to this arrangement, the space in which the holder 6 and connector 2 are installed becomes small, and the axial length of the fuel injector 1 can be shortened. Also, the holder 6 is supported by the fuel supply pipe 3, so it is not necessary to support the holder 6 using a special support member, and the number of members required for the support structure of the fuel injector 1 can also be suppressed low.

Figure 6:
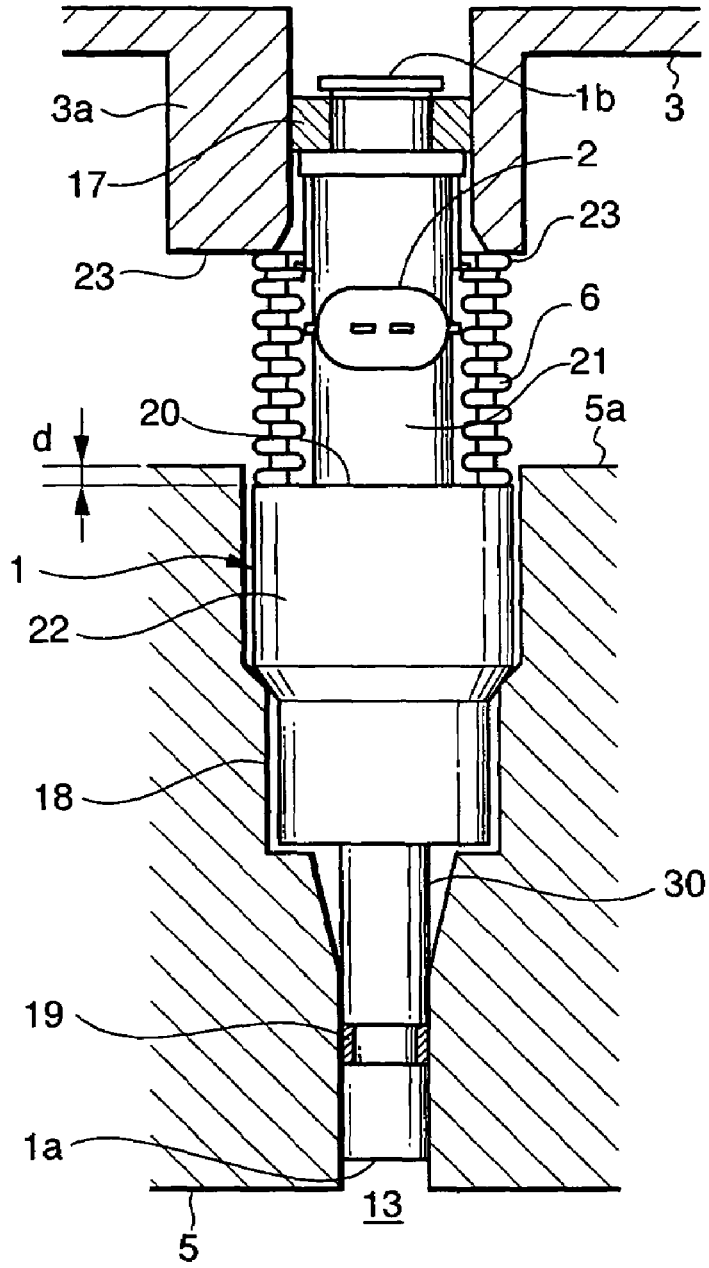
FIG. 6 is a longitudinal sectional view of a fuel injector support structure according to a second embodiment of this invention.

Next, referring to FIG. 6, a second embodiment of this invention will be described. In the second embodiment, parts having the same construction as those of the first embodiment are given identical part numbers, and their description is omitted.

In this embodiment, the dimensional setting of the hole 18 differs from that of the first embodiment.

In this embodiment, the locating hole 18 is formed a little deeper that of the first embodiment so that the spring receptacle part 20 is a little lower than the outer surface 5*a* of the cylinder head 5 and the spring receptacle part 20 is situated inside the hole 18. The size of the hole 18 is set so that a level difference d between the outer surface 5*a* and the spring receptacle part 20 corresponds to at least one step of the bellows of the holder 6. The snap ring 16 used in the first embodiment is omitted in this embodiment.

In this embodiment, the wall surface of the hole 18 which corresponds to the level difference d prevents bulging deformation of the holder 6 due to the action of the axial load instead of the snap ring 16. Therefore, an effect equivalent to that of the first embodiment can be obtained without providing the snap ring 16.

Figure 7:
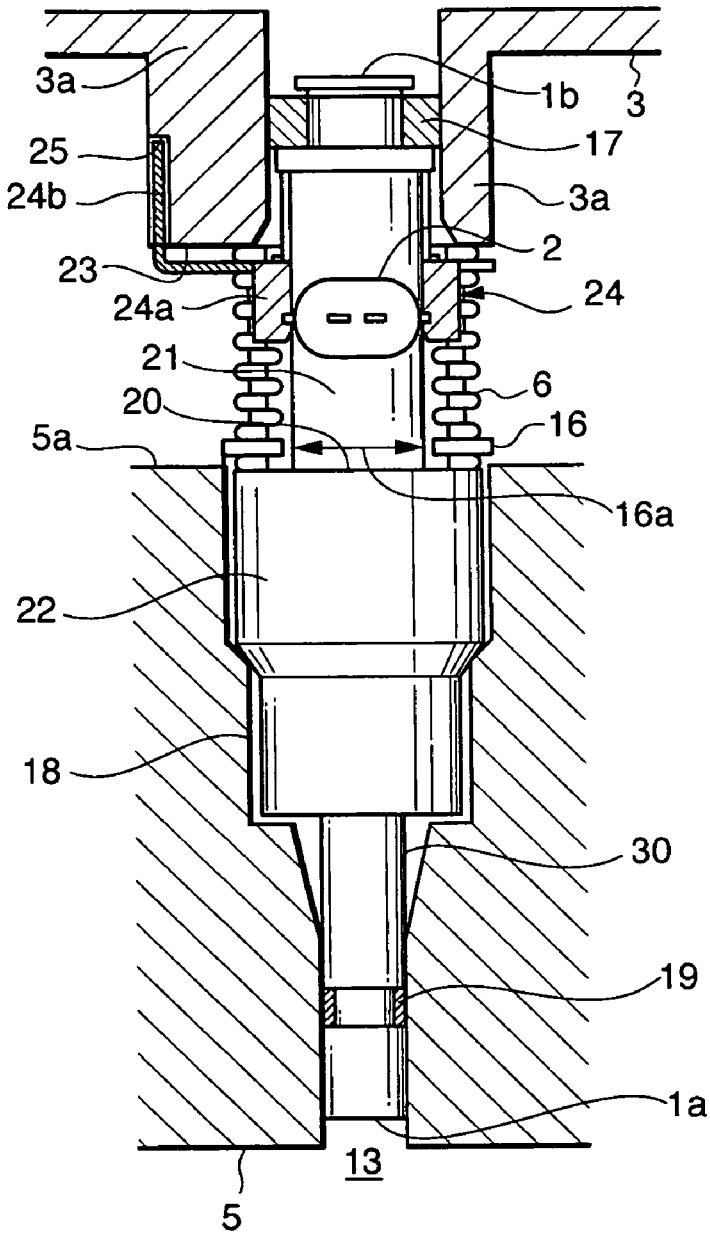
FIG. 7 is similar to FIG. 6, but showing a third embodiment of this invention.

Next, referring to FIG. 7, a third embodiment of this invention will be described. In this embodiment, in addition to the construction of the first embodiment, the holder 6 is provided with a positioning member 24, and a restraining part 25 is formed in the boss 3*a* of the fuel supply pipe 3.

The positioning member 24 has a body part 24*a* having the same C-shaped cross-section as that of the holder 6 which fits into the cylindrical part 21 around the connector 2, and a rotation lock part 24*b* which projects from the upper end of the body part 24*a* in a lateral direction. A notch of C-shaped cross-section of the body part 24*a* is formed to have a width which fits the connector 2. The body part 24*a* is fitted on the outer circumference of the cylindrical part 21 from the opposite direction to the connector 2. In the fitted state, the body part 24*a* grips the connector 2 from both sides.

The rotation lock part 24*b* comprises a belt-like plate, and is bent upwards along the outer circumference of the boss 3*a* so as to enclose the lower end 23 of the boss 3*a*. The restraining part 25 which is a vertical groove that restrains the rotation lock part 24*b*, is formed in the outer circumference of the boss 3*a*. The rotation lock part 24*b*, by fitting its tip into the vertical groove-like restraining part 25, restricts the rotation displacement of the fuel injector 1 relative to the boss 3*a*.

During assembly, the body part 24*a* and holder 6 are fitted into the cylindrical part 21 of the fuel injector 1, and the fuel injector 1 is inserted in the hole 18 of the cylinder head 5 while the holder 6 is restrained by the snap ring 16. The boss 3*a* of the fuel supply pipe 3 is inserted in the cylindrical part 21 of the fuel injector 1, and after adjusting the rotation position of the fuel injector 1 so that the rotation lock part 24*b* of the positioning member 24 fits into the restraining part 25 of the boss 3*a*, the fuel supply pipe 3 is fixed to the cylinder head 5 by the bolt 4.

According to this embodiment, the rotation displacement of the fuel injector 1 is prevented and the orientation of the connector 2 is fixed.

Therefore, when connecting a signal cable to the connector 2, it is not necessary to correct the orientation of the connector 2. Directional deviation in the spray shape of the fuel injector 1 may arise due to the intake air flow in the combustion chamber 13. By appropriately setting the rotation angle of the fuel injector 1 positioned by the projecting part 24*b* and restraining part 25 according to this directional deviation the fuel injector 1 definitively forms a fuel spray in a desired direction.

In addition to the modifications shown in this embodiment, various variations are possible for the construction of the projecting part 24*a* and restraining part 25. For example, regarding the restraining part 25, a groove which houses the projecting part 24*a* may be formed on the under surface 23 of the boss 3*a* instead of forming the vertical groove in the outer circumference of the boss 3*a*.

Alternatively, it is possible to bend the rotation lock part 24*b* downward, and to provide the restraining part 25 in the cylinder head 5. In this case, the fuel injector 1 is set in the hole while adjusting the rotation angle of the fuel injector 1 so that the rotation lock part 24*b* fits into the restraining part 25.

According to this embodiment, in addition to the advantage of the first embodiment, positioning the orientation of the connector 2 is easy. The positioning member 24 and restraining part 25 may be applied also to the second embodiment.

The contents of Tokugan 2004-269521, with a filing date of Sep. 16, 2004 in Japan, are hereby incorporated by reference.

Although the invention has been described above by reference to certain embodiments of the invention, the invention is not limited to the embodiments described above. Modifications and variations of the embodiments described above will occur to those skilled in the art, within the scope of the claims.

For example, although each of the above embodiments is intended for an in-cylinder injection-type internal combustion engine, by providing the locating hole 18 in an intake manifold instead of the cylinder head 5, they can be applied also to an internal combustion engine of the port injection type. Further, the above embodiments were discussed in the context of a top-feed type fuel injector 1, but this invention may be applied also to a side-feed type fuel injector, having the pipe connector 1*b* on a lateral surface.

This application claims priority from Japanese Patent Application 2004-269521, filed Sep. 16, 2004, which is incorporated herein by reference in its entirety.

The embodiments of this invention in which an exclusive property or privilege is claimed are defined as follows:

What is claimed is:

1. A support structure for a fuel injector of an internal combustion engine, the fuel injector being formed in a cylindrical shape, and having a projecting part projecting in a lateral direction, comprising:

an engine member which has a hole for inserting the fuel injector;

an elastic member formed in a cylindrical shape with a notch to have a C-shaped cross-section, and fitted to the fuel injector on the opposite side from the projecting part to elastically support the fuel injector in a state where a tip of the fuel injector is inserted into the hole;

a support member which supports the elastic member; and a member which prevents deformation of the elastic member in a lateral direction with respect to an axis of the fuel injector under a compressive load exerted by the engine member and the support member.

2. The support structure as defined in claim 1, wherein the projecting part projects from the notch of the elastic member in the lateral direction.

3. The support structure as defined in claim 1, wherein the elastic member comprises a metal bellows.

4. The support structure as defined in claim 1, wherein the deformation preventing member comprises a snap ring of C-shaped cross-section which is fitted on the outer circumference of the elastic member.

5. The support structure as defined in claim 4, wherein the snap ring is fitted on the outer circumference of the elastic member at a position offset from the middle of the elastic member in an axial direction of the fuel injector toward the tip.

6. The support structure as defined in claim 1, wherein the fuel injector comprises a spring receptacle part in contact with the elastic member, the spring receptacle part being situated on the inside of the hole when the tip of the fuel injector is inserted in the hole, and the deformation prevention member is formed by the wall surfaces of the hole surrounding the spring receptacle part.

7. The support structure as defined in claim 1, further comprising a positioning member of C-shaped cross-section fitted to the fuel injector from the opposite side to the projecting part in the same plane as the projecting part, wherein an opening part of the positioning member fits the projecting part, and the positioning member comprises a rotation lock part which projects in a lateral direction, and engages with one of the support member and the engine member.

8. The support structure as defined in claim 1, wherein the support member comprises a fuel supply pipe which supplies fuel to the fuel injector, and which is fixed to the engine member.

9. The support structure as defined in claim 1, wherein the engine member comprises one of a cylinder head and an intake manifold of the engine.

10. The support structure as defined in claim 1, wherein the projecting part comprises one of a connector which connects a signal cable to the fuel injector, and a pipe connection part which introduces fuel into the fuel injector.

* * * * *